US008601762B2

(12) United States Patent
Walker, III

(10) Patent No.: US 8,601,762 B2
(45) Date of Patent: Dec. 10, 2013

(54) ADJUSTABLE ATTACHMENT SYSTEM

(75) Inventor: John Robert Walker, III, Plymouth, MN (US)

(73) Assignee: Enclos Corporation, Eagan, MN (US)

( * ) Notice: Subject to any disclaimer, the term of this patent is extended or adjusted under 35 U.S.C. 154(b) by 213 days.

(21) Appl. No.: 12/422,754

(22) Filed: Apr. 13, 2009

(65) Prior Publication Data

US 2009/0255206 A1 Oct. 15, 2009

Related U.S. Application Data

(63) Continuation of application No. 11/208,444, filed on Aug. 19, 2005, now abandoned.

(51) Int. Cl.
*E04H 1/00* (2006.01)

(52) U.S. Cl.
USPC ..... 52/235; 52/704

(58) Field of Classification Search
USPC ..... 52/699, 235, 704
See application file for complete search history.

(56) References Cited

U.S. PATENT DOCUMENTS

| | | | |
|---|---|---|---|
| 1,841,887 | A | 1/1932 | Goldsmith et al. |
| 2,109,520 | A | 3/1938 | Awbrey |
| 2,901,785 | A | 9/1959 | Hinchliffe et al. |
| 2,914,145 | A | 11/1959 | Russell |
| 3,176,806 | A | 4/1965 | Ferrell |
| 3,600,854 | A | 8/1971 | Dellaire et al. |
| 3,771,276 | A | 11/1973 | Stewart et al. |
| 3,858,375 | A | 1/1975 | Silvernail |
| 3,936,986 | A | 2/1976 | Steel |
| 3,968,608 | A | 7/1976 | Swango |
| 3,990,201 | A | 11/1976 | Falbel |
| 4,265,300 | A | 5/1981 | Kurimoto |
| 4,267,673 | A | 5/1981 | Coulston |
| 4,285,184 | A | 8/1981 | Turner, Jr. |
| 4,453,855 | A | 6/1984 | Richter et al. |
| 4,473,984 | A | 10/1984 | Lopez |
| 4,506,595 | A | 3/1985 | Roberts et al. |
| 4,543,755 | A | 10/1985 | Crandell |

(Continued)

FOREIGN PATENT DOCUMENTS

| | | |
|---|---|---|
| DE | 3401996 | 7/1984 |
| DE | 196 35 466 A1 | 3/1998 |

(Continued)

OTHER PUBLICATIONS

Halfen® Anchoring Systems, brochure for "Curtainwall Anchoring: Top of Slab Condition," Date of Publication Unknown. 4 pages.

(Continued)

*Primary Examiner* — Branon Painter
(74) *Attorney, Agent, or Firm* — Kenneth E. Levitt; Dorsey & Whitney LLP

(57) ABSTRACT

An adjustable attachment system is provided for attaching a unit to a base. The adjustable attachment system comprises an embed, a bridging clip and a locking strip. The bridging clip is adapted for receiving an attachment piece, to which the unit may be attached. The embed is positioned in an outward facing surface of the base. The bridging clip is positioned in the embed at a desired in/out position. The position of the bridging clip may be adjusted in two orthogonal directions. The locking strip is inserted between the bridging clip and the embed to fix the bridging clip in place.

7 Claims, 27 Drawing Sheets

(56) References Cited

U.S. PATENT DOCUMENTS

| | | | | |
|---|---|---|---|---|
| 4,546,582 | A | 10/1985 | Gartner | |
| 4,565,040 | A | 1/1986 | Kaminaga | |
| 4,633,631 | A | 1/1987 | Crandell | |
| 4,644,717 | A | 2/1987 | Biebuyek | |
| 4,658,559 | A | 4/1987 | Doherty | |
| 4,724,637 | A | 2/1988 | Evans | |
| 4,738,065 | A | 4/1988 | Crandell | |
| 4,831,799 | A | 5/1989 | Glover et al. | |
| 4,869,036 | A | 9/1989 | Peacock | |
| 4,873,805 | A | 10/1989 | Ting | |
| 4,879,842 | A | 11/1989 | Bailey | |
| 4,905,444 | A | 3/1990 | Semaan et al. | |
| 4,947,615 | A | 8/1990 | Peacock | |
| 4,951,438 | A * | 8/1990 | Thoresen | 52/252 |
| 4,952,430 | A | 8/1990 | Bowser et al. | |
| 5,063,718 | A | 11/1991 | Nonis | |
| 5,067,292 | A * | 11/1991 | Finean | 52/235 |
| 5,094,052 | A | 3/1992 | Gudmundsson et al. | |
| 5,156,894 | A | 10/1992 | Hood et al. | |
| 5,158,392 | A | 10/1992 | Takeda | |
| 5,197,255 | A | 3/1993 | Fricker | |
| 5,243,805 | A | 9/1993 | Fricker | |
| 5,253,459 | A | 10/1993 | Parinas et al. | |
| 5,267,419 | A | 12/1993 | Yokota et al. | |
| 5,355,645 | A | 10/1994 | Farag | |
| 5,435,107 | A | 7/1995 | Seibold | |
| 5,481,839 | A | 1/1996 | Lang et al. | |
| 5,544,465 | A | 8/1996 | Hood et al. | |
| 5,548,939 | A * | 8/1996 | Carmical | 52/707 |
| 5,598,669 | A | 2/1997 | Hamdi et al. | |
| 5,601,677 | A | 2/1997 | Leopold | |
| 5,623,804 | A * | 4/1997 | Kelly et al. | 52/704 |
| 5,890,340 | A | 4/1999 | Kafarowski | |
| 5,937,597 | A | 8/1999 | Sono et al. | |
| 5,942,736 | A | 8/1999 | Cortonesi | |
| 5,992,111 | A | 11/1999 | Waterhouse | |
| 6,032,423 | A | 3/2000 | Takemura et al. | |
| 6,056,037 | A | 5/2000 | Jonkman, Sr. et al. | |
| 6,345,485 | B1 | 2/2002 | Boone et al. | |
| 6,360,498 | B1 | 3/2002 | Westphal | |
| 6,581,354 | B1 | 6/2003 | Skarpness | |
| 6,591,562 | B2 | 7/2003 | Ting | |
| 6,598,361 | B2 * | 7/2003 | Ting | 52/235 |
| 6,612,091 | B1 | 9/2003 | Glover et al. | |
| 6,658,804 | B2 | 12/2003 | Leytes et al. | |
| 6,668,974 | B1 | 12/2003 | Mottelet et al. | |
| 6,715,248 | B2 | 4/2004 | Biebuyck | |
| 6,722,089 | B2 | 4/2004 | Budzinski | |
| 6,749,363 | B1 | 6/2004 | Petersen | |
| 6,935,077 | B2 | 8/2005 | Wulfert et al. | |
| 7,104,015 | B2 | 9/2006 | Huynh | |
| 7,134,247 | B2 | 11/2006 | Ting | |
| 7,281,561 | B2 | 10/2007 | Anderson et al. | |
| 7,516,583 | B2 | 4/2009 | Mitchell | |
| 7,588,653 | B2 | 9/2009 | Crandell et al. | |
| 7,637,063 | B2 | 12/2009 | Sensini | |
| 2004/0168382 | A1 | 9/2004 | Rudduck et al. | |
| 2005/0235581 | A1 | 10/2005 | Cohen et al. | |
| 2006/0059801 | A1 | 3/2006 | Allaei | |
| 2006/0080902 | A1 | 4/2006 | Bren | |
| 2007/0022682 | A1 | 2/2007 | Morgenegg et al. | |
| 2008/0222981 | A1 | 9/2008 | De Gobbi | |
| 2009/0008185 | A1 | 1/2009 | Cheng et al. | |
| 2009/0311449 | A1 | 12/2009 | Fehlmann et al. | |
| 2010/0009619 | A1 | 1/2010 | Christensen et al. | |
| 2010/0281797 | A1 | 11/2010 | Yun | |

FOREIGN PATENT DOCUMENTS

| | | |
|---|---|---|
| EP | 0819817 | 1/1998 |
| FR | 2907490 | 4/2008 |
| JP | 2003063844 | 3/2003 |
| JP | 2004210553 | 7/2004 |
| JP | 2004324268 | 11/2004 |
| JP | 2005104764 | 4/2005 |
| JP | 2008024546 | 2/2008 |
| JP | 2008115078 | 5/2008 |
| JP | 2008266062 | 11/2008 |
| WO | WO 01/25581 | 4/2001 |

OTHER PUBLICATIONS

Wausau Window and Wall Systems, data sheet for Curtainwall, 7250-UW Series, (2004), 1 page.

Halfen® Anchoring Systems, data sheet for Curtain Wall Anchors, 1 page. Unknown publication date.

Halfen® Anchoring Systems, data sheet for Halfen Multi-Adjustable Curtain Wall Clips, 1 page. Unknown publication date.

Halfen® Anchoring Systems, data sheet for Hi-Tensile Inserts, 1 page. Unknown publication date.

R.L. Quirouette, "Glass and Metal Curtain Wall Systems," *Building Science Insight* (National Research Council Canada—Institute for Research in Construction) (1982), retrieved at http://irc.nrc-cnrc.gc.ca/bsi/82-3_E.html, (15 pages).

Traco Architectural Systems, Inc., data sheet for Curtain Wall System (Outside Glazed), (Effective Nov. 2002), 1 page.

Kawneer Company, Inc., pp. 1 and 3 of data sheet for Sealair® Architectural Windows: Unequal Leg Sills, 7225 and 8225T•L Windows, (1994), 2 pages.

Kawneer Company, Inc., pp. 1-2 of data sheet for Sealair® Architectural Windows: Typical Installation Details, 7225 and 8225T•L Windows, (1994), 2 pages.

Technical Glass Products (TGP), data sheets for Curtainwall series 60/120 Minute Fire-rated Frame System Reference Elevation (Jul. 2003), 18 pages.

Texas Wall Systems, Inc., Product profiles for: 04 Stool Horizontal; 06 Sill Horizontal; 12 Sill Horizontal; 04 Sill Horizontal; and 06 Sill Horizontal (Retrieved from http://www.texaswall.com on May 21, 2005), 5 pages total.

Halfen® Anchoring Systems, data sheet for Strip Window to Precast Panel Connection (1998), 1 page.

Halfen® Anchoring Systems, data sheet for Punched or Strip Windows Anchors in Architectural Precast Panels (1998), 1 page.

Halfen® Anchoring Systems, data sheet for Double Tee Connection to Ledger Beam (1998), 1 page.

Halfen® Anchoring Systems, data sheet for Double Tee Connection to Shear Wall or Column (1998), 1 page.

Halfen® Anchoring Systems, data sheet for Access Ladder Connection for Precast Utility Units (1998), 1 page.

Halfen® Anchoring Systems, data sheet for Halfen Anchors at Joints of Precast Sewer Chimneys and Wet Wells (1998), 1 page.

Halfen® Anchoring Systems, data sheet for Expansion Joint Anchoring Detail (1998), 1 page.

American Architectural Manufacturers Association, "Aluminum Curtain Wall Design Guide Manual," p. 122-125 (1979).

Traco™ Architectural Systems,®, Inc, drawings showing SSG Mullion and Anchoring Details (Drawn on Jun. 12, 2002), 2 sheets.

Enclos Corporation, drawings showing horizontal details of vision sill starter (Drawn Mar. 4, 2004), 1 sheet.

Enclos Corporation, drawings showing spandrel stack head sections/shearwall section (Drawn Mar. 3, 2004), 1 sheet.

Enclos Corporation, drawings showing louver vertical details/anchor at louvers and anchor at louvers/spandrel (Drawn Mar. 5, 2004), 1 sheet.

Enclos Corporation, drawings showing louver corner anchor details/OS corner at louver (Drawn Mar. 12, 2004), 1 sheet.

* cited by examiner

ADJUSTABLE ATTACHMENT SYSTEM

CROSS-REFERENCE TO RELATED APPLICATION(S)

This application is a continuation of U.S. patent application Ser. No. 11/208,444, filed Aug. 19, 2005, the subject matter of which is incorporated herein by reference.

FIELD OF THE INVENTION

The present invention relates to an adjustable attachment system. More specifically, the present invention relates to an adjustable attachment system wherein a bridging clip adapted for receiving an attached component is placed in an embed and the positioning of the bridging clip may be adjusted in two orthogonal directions.

BACKGROUND OF THE INVENTION

Construction technology often employs unitized curtainwall units that are anchored to the building structure. A curtainwall system is a lightweight exterior cladding which is hung on the building structure, usually from floor to floor. It can provide a variety of exterior appearances. Curtainwalls are designed to accommodate structural deflections, control wind-driven rain and air leakage, minimize the effects of solar radiation, and provide for maintenance-free long term performance.

The curtainwall is an external, lightweight, generally nonloadbearing wall that is hung from a frame rather than built up from the ground; the framework it shields is usually of concrete or steel. Curtainwalls may be used with any suitable structure but are typically used in high-rise blocks. Typically light, the use of curtainwalls reduces the forces on the foundations, making the building lighter. Curtainwalls are a form of prefabricated construction and can be installed with relative ease, even at significant heights above the ground. Curtainwalls are frequently produced in a ready-to-install form, and thus can be installed as discrete building units.

One aspect of both the design and the installation of a curtainwall is its anchorage to the building structure. Generally, the curtainwall units are anchored to concrete floor slabs, columns and/or shear wall of building structures. Many types of anchor and a variety of methods are used.

Prior art attachment mechanisms for anchoring the curtainwall units to the building structure generally comprise manufactured plates, channel struts, and drilled anchor bolts. Strut type embeds are used in attachment to the face of slab, to columns, or to shear walls. The distance from the building frame face (slab, shear wall, or column) to the back of the curtainwall is desired at approximately at least 2.5 times the specified allowable concrete tolerance plus the bridging clips thickness. Embedded strut type embeds typically have limited, preset depth and thus have no capability for in/out adjustment perpendicular to the plane of the frame to absorb tolerance. Thus, strut type embeds have lateral adjustment only in the plane of the slab, column, or shear wall. In order to effect in/out adjustment, complex two-part primary bridging clips plus ancillary parts are used and must be bolted or welded together to form an assembly. The assembly is then bolted to the strut embed. Protrusions such as the protrusion of the assembly from the strut embed may encroach on the in/out tolerance desired with the distance from the building frame. Further, the two-part bridging clips used for strut type embeds generally interfere and or extend into the plane of the backside of the curtainwall units.

FIGS. 1-3 illustrate prior art anchor systems for attaching a curtain wall to a building frame. FIGS. 1 and 2 illustrate a face of slab anchor system 100. FIG. 3 illustrates a top of slab anchor system 102. As shown, the face of slab anchor system 100 comprises an embed anchor 104, an adjustment piece 106, and an attached piece 110. The embed anchor 104 extends a preset amount into the slab 112. In/out adjustability is provided by the adjustment piece 106. The adjustment piece 106 extends from the face of the slab 112 and thus encroaches on the in/out tolerance of the distance of the attached piece 110 to the slab 112. The attached piece 110 is coupled to the adjustment piece 106.

The top of slab anchor system 102 of FIG. 3 illustrates an embed anchor 114, an adjustment and attachment piece 116, and an attached piece 118. The embed anchor 114 is anchored in the top of the slab 112. The adjustment and attachment piece 116 extends towards the face of the slab 112. The amount of extension of the adjustment and attachment piece 116 determines whether the adjustment and attachment piece 116 is flush with the face of the slab 112 or extends beyond the face of the slab 112. The attached piece 118 is coupled to the adjustment and attachment piece 116. This coupling may be achieved directly or indirectly.

In the past, it has been desirable to locate an anchor in an easily accessible location on top of the floor slab because, while a location on the slab edge, or on the outward facing surface of the frame, is feasible, drilling and welding on the slab edge is more difficult and there is les room for adjustment to accommodate building frame variations. Curtainwall units must be anchored and fixed to a precise theoretical location in space irrespective to the frame's finished location. The difference between the two locations is referred to as tolerance. To bridge the difference in these locations, manufactured parts known as adjustable anchor clips (or adjustable secondary bridging clips) are employed. The clips are typically made utilizing slotted holes, shims or field welding to make the connection between the point of attachment on a building structure and a curtainwall unit.

BRIEF SUMMARY OF THE INVENTION

An adjustable attachment system and method for attaching a unit to a base is provided.

The adjustable attachment system comprises an embed, a bridging clip and a locking strip. The embed and bridging clip are configured for the bridging clip to be inserted within the embed and the bridging clip and the embed to engage one another. The locking strip is configured for insertion in a space between the bridging clip and the embed to fix the bridging clip in place. The bridging clip may further be adapted for receiving an attachment piece. The embed is anchored to the base and the bridging clip is coupled, directly or indirectly, to the unit to be attached. For attaching a curtainwall unit to a building frame, the embed is anchored in the frame and the bridging clip is coupled to the curtainwall unit.

The method of attaching a unit to a base comprises placing the embed in a base. For example, the embed may be placed in a concrete form and concrete poured into the form. A bridging clip is inserted in the embed, and positioned at a desired position within the embed. A locking strip is inserted in a space between the bridging clip and the embed. The unit is coupled to the bridging clip. Optionally, an attachment piece may be used to couple the unit to the bridging clip.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION OF THE INVENTION

An adjustable attachment system is provided for attaching a unit to a base. While the adjustable attachment system is discussed in reference to attaching a curtainwall unit to a building frame, the adjustable attachment system may be used to attach any unit to any base. For example, the adjustable attachment system may be used to attach a pipe to a base. Further, the attachment system may be used to attach any unit to any surface of a base. For example, the adjustable attachment system may be used to attach a unit to a top surface, bottom surface, or side surface of a base.

The adjustable attachment system permits adjustment in two orthogonal directions, in/out and laterally. Additionally, up/down adjustment may be provided using attachment pieces. The adjustable attachment system comprises an embed, a bridging clip, and a locking strip. The bridging clip may be connected to the embed without the use of bolts and nuts or field welding. The bridging clip thus does not require holes, slots or notches. The adjustable attachment system simplifies locating a curtainwall anchor in the outward facing surface of the frame. Using the adjustable attachment system, the speed of erection and placement of curtainwall units is increased while costs are decreased.

Figure 1:
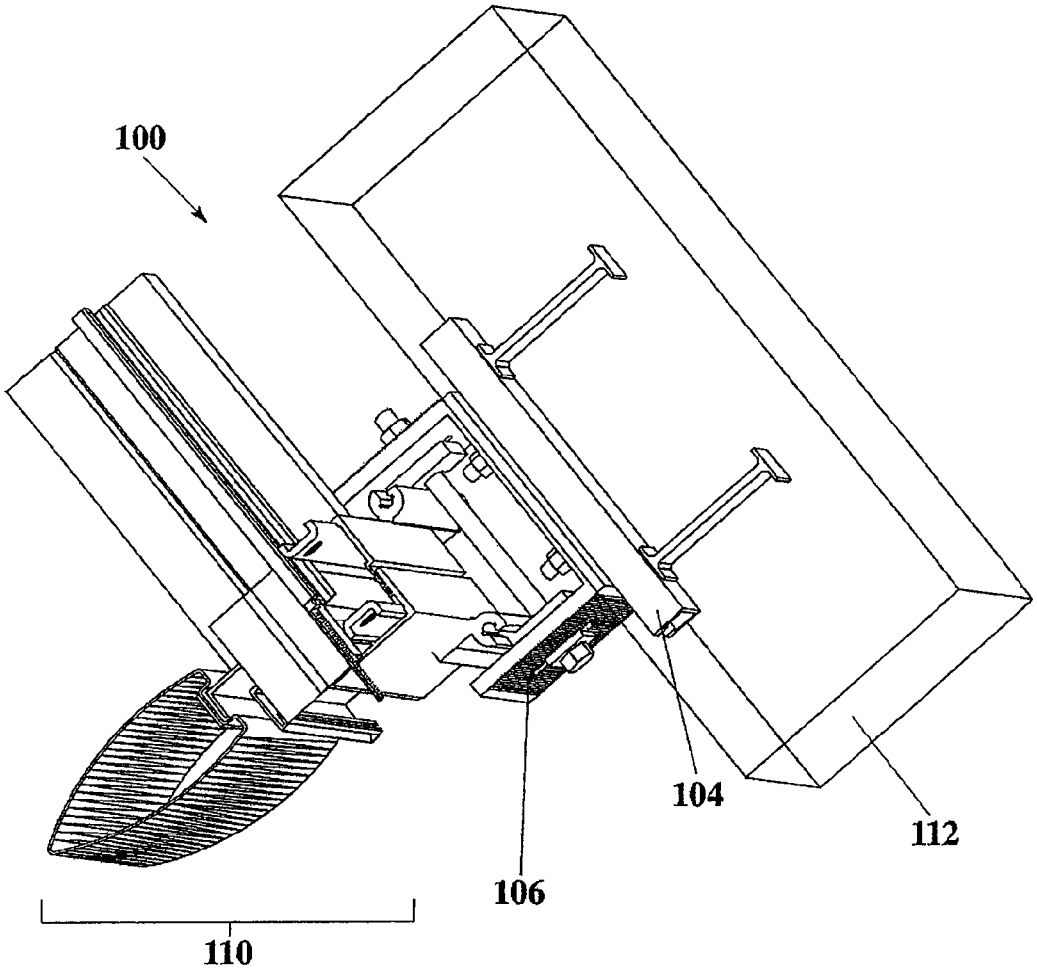
Figure 1 (Prior Art)
FIG. 1 illustrates a prior art anchor for attaching a curtainwall unit to a building frame.
Figure 2:
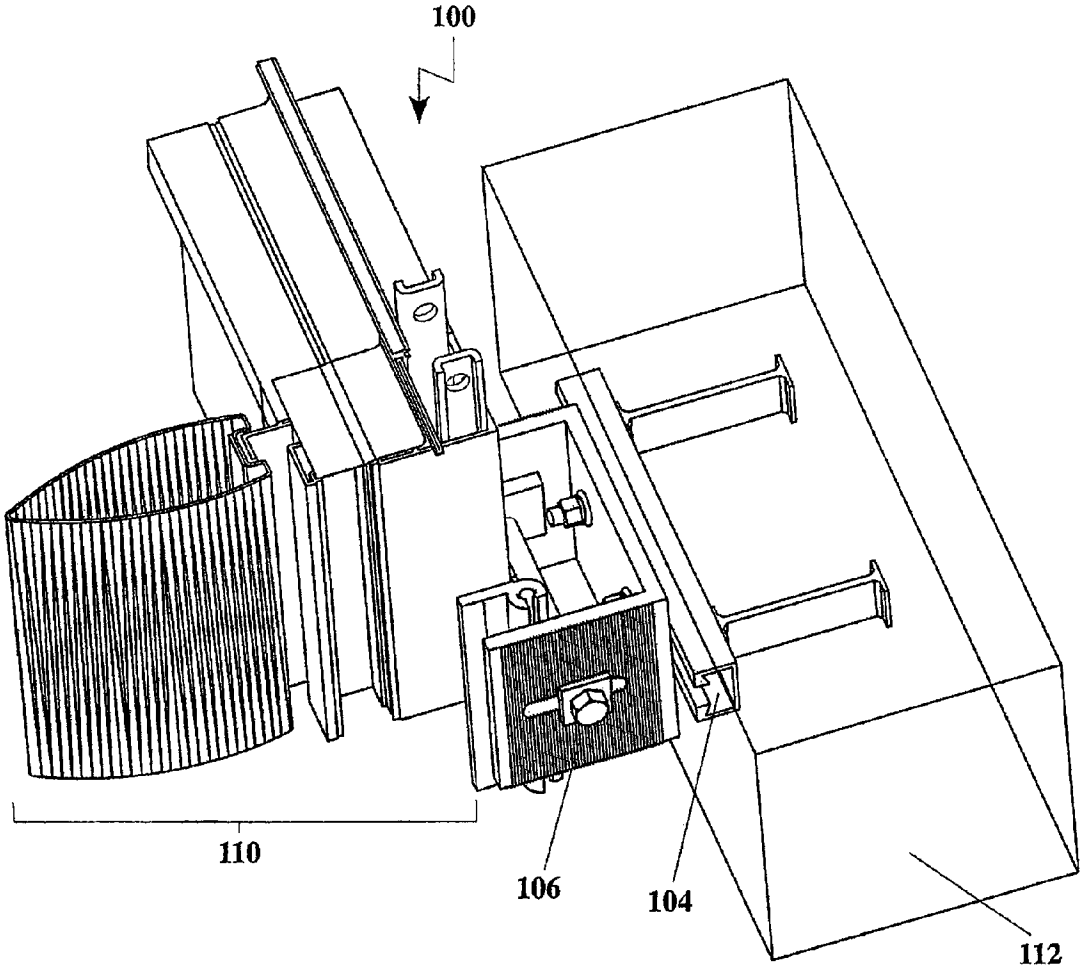
Figure 2 (Prior Art)
FIG. 2 illustrates a prior art anchor for attaching a curtainwall unit to a building frame.
Figure 3:
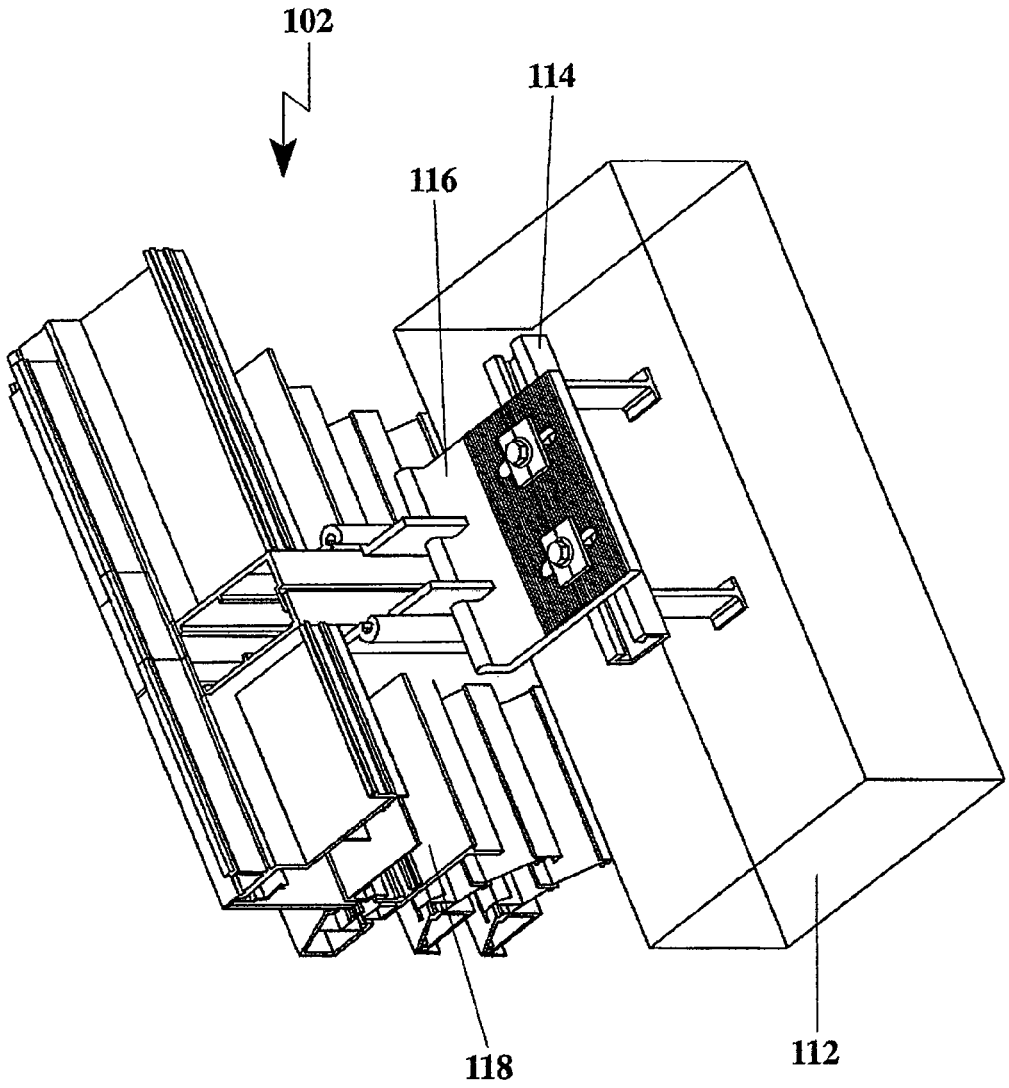
Figure 3 (Prior Art)
FIG. 3 illustrates a prior art anchor for attaching a curtainwall unit to a building frame.
Figure 4:
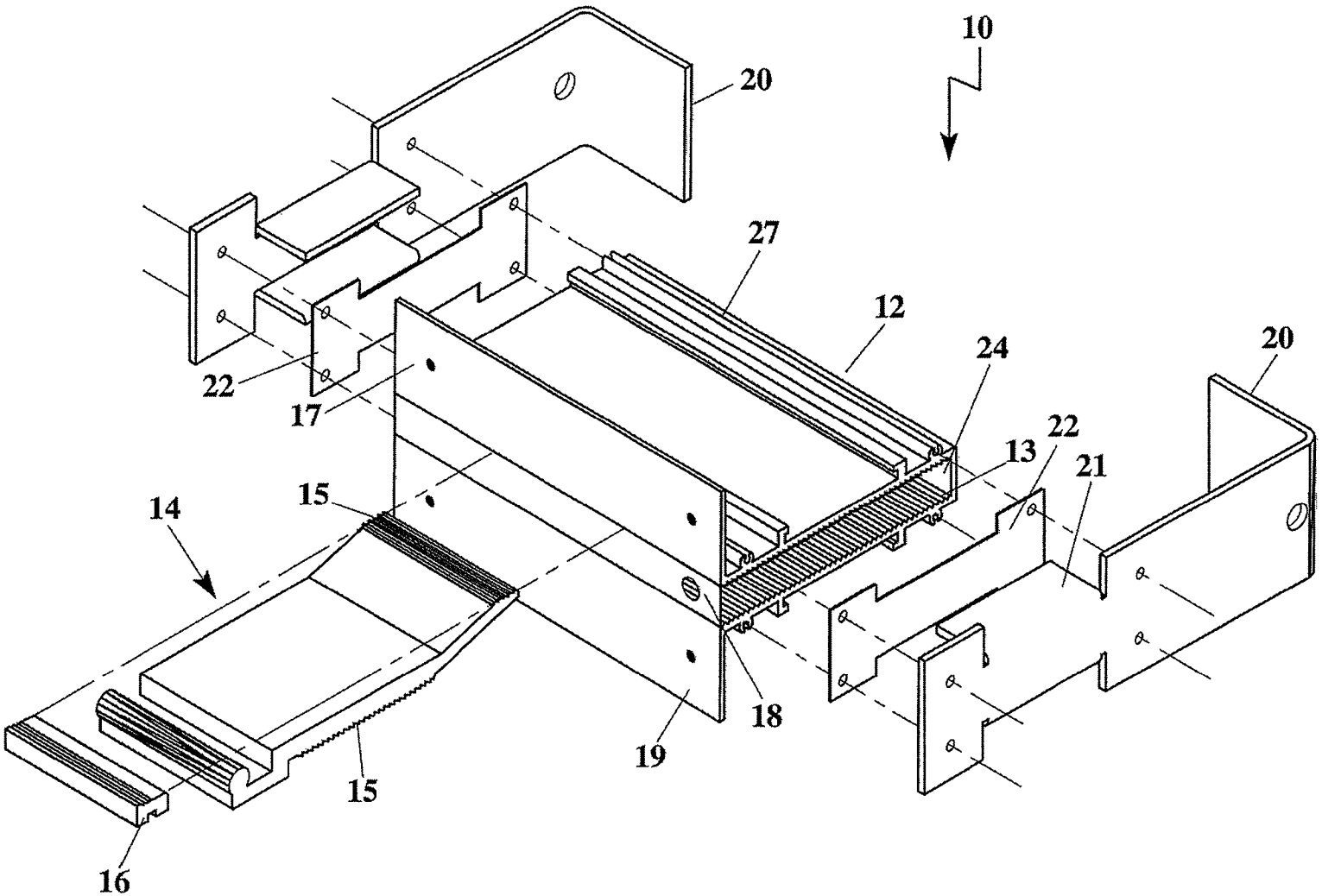
FIG. 4 illustrates an exploded perspective view of an adjustable attachment system in accordance with one embodiment of the present invention.
Figure 5:
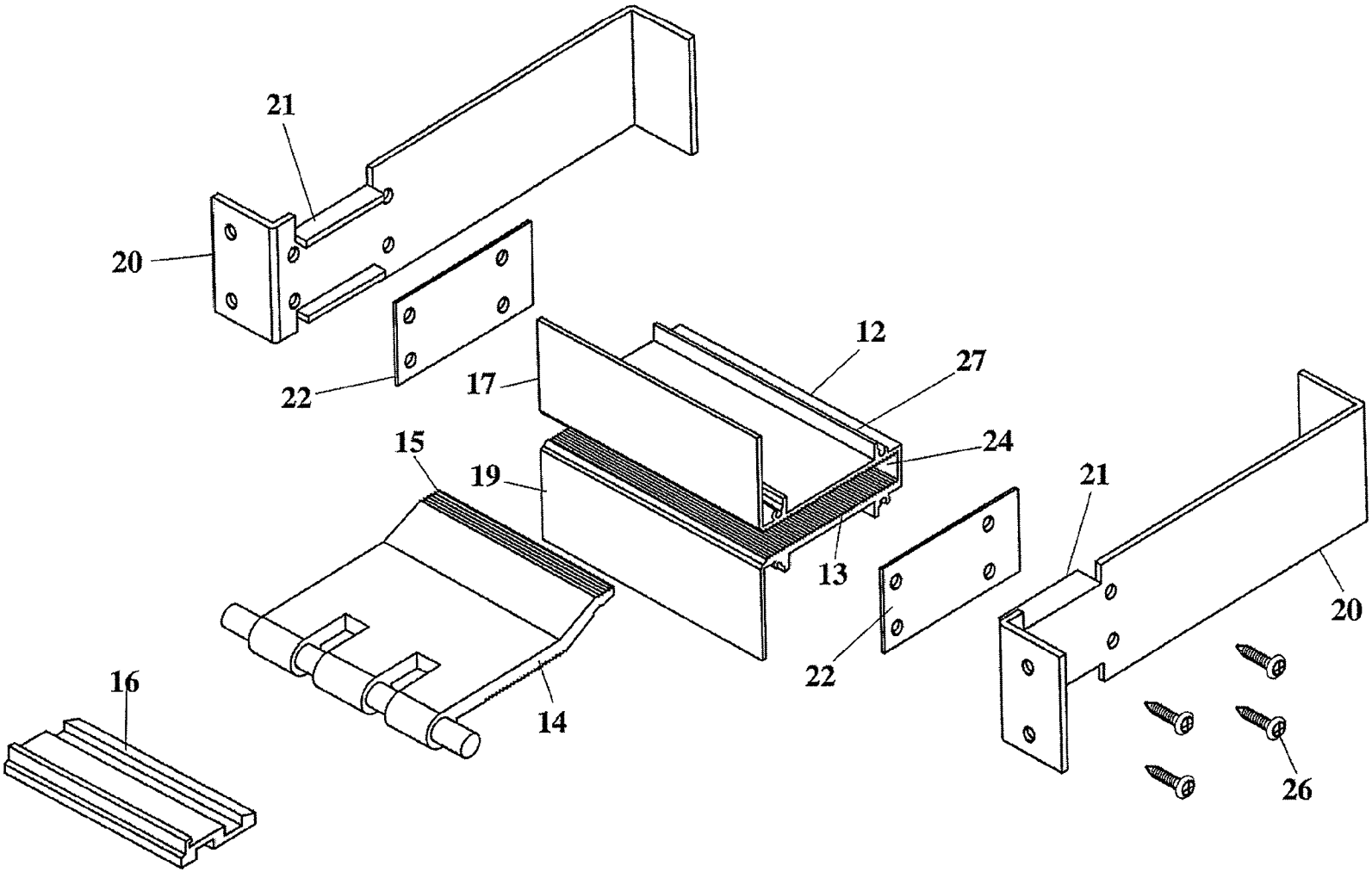
FIG. 5 illustrates an exploded perspective view of an adjustable attachment system in accordance with one embodiment of the present invention.
Figure 6:
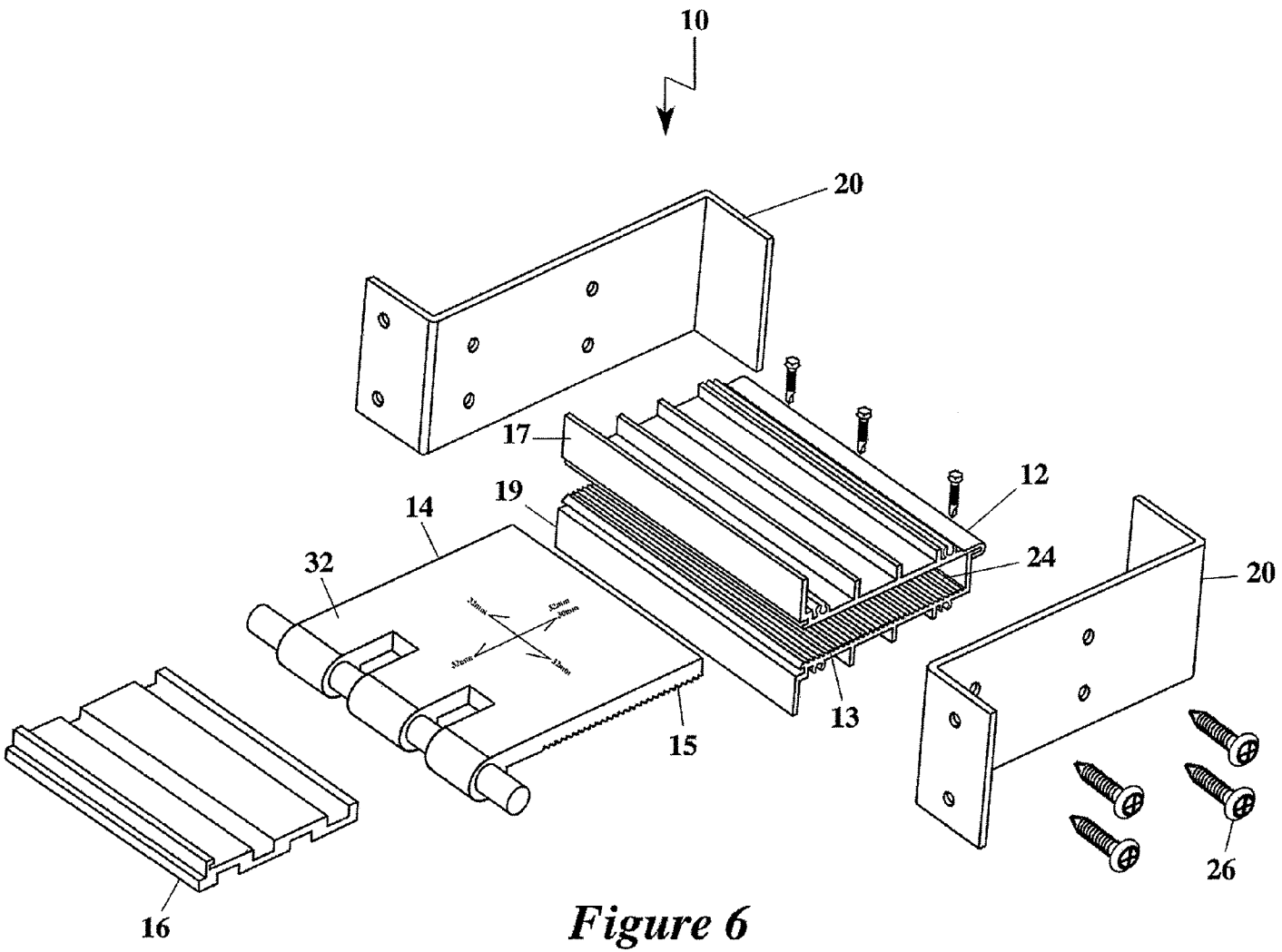
FIG. 6 illustrates an exploded perspective view of an adjustable attachment system in accordance with one embodiment of the present invention.

FIGS. 4, 5, and 6 illustrate exploded views of alternate embodiments of an adjustable attachment system 10. As shown, the adjustable attachment system 10 comprises an embed, a bridging clip (or anchor plate) 14, and a locking strip (or wedge block) 16. A peel strip 18, described more fully below, may be provided along a front face of the embed 12.

The embed 12 is positioned in a recess in an outward facing surface of base, as described more fully below. The outward facing surface may be any surface of the base. Thus, for example, the outward facing surface may be a top surface, a bottom surface, or a side surface. The bridging clip 14 is inserted into the embed 12 to a desired in/out position. Teeth 13 are provided along at least one of an upper and lower inner surface of the embed 12. Corresponding teeth 15 are provided along at least one of an upper and lower surface of the bridging clip 14. Once the bridging clip 14 is in the desired in/out position, the teeth 15 on the bridging clip 14 are engaged with the teeth 13 of the embed 12. Thus, teeth 15 provided along an upper surface of the bridging clip 14 engage teeth 13 provided along an upper inner surface of the embed 12. Similarly, teeth 15 provided along a lower surface of the bridging clip 14 engage teeth 13 provided along a lower surface of the embed 12. The position of the bridging clip 14 in the embed 12 may be adjusted laterally. When the desired position is achieved, the locking strip 16 is inserted between the bridging clip 14 and the embed 16 to fix the bridging clip 14 in place.

Thus, adjustment of the bridging clip 14 is allowed in two orthogonal directions, in/out and laterally. The bridging clip 14 may be connected to the embed 12 without using bolts and nuts or field welding (though bolts, nuts, field welding or other construction techniques may be used if desired).

End closure arms 20 (or anchor plates) may be provided with the adjustable attachment system. FIGS. 4, 5, and 6 each illustrate alternate embodiments of the end closure arms 20. The end closure arms 20 operate to seal the interior of the embed 12 from leakage of material along the sides 24 of the embed 12. The end closure arms 20 further provide increased gripping surface along the embed 12. Thus, if the embed 12 is used with a concrete structure and concrete is poured around the embed 12, the concrete has the increased gripping surface of the end closure arms 20 for engagement.

In the embodiments of FIGS. 4 and 5, end seals 22 are provided for positioning between the embed 12 and the end closure arms 20. Thus, after assembled for positioning within the recess, sides 24 of the embed 12 are coupled to the end seals 22 and the end seals 22 are in turn coupled to the end closure arms 20. The embed 12, end seals 22 and end closure arms 20 may be coupled to one another in any suitable manner. For example, fasteners such as screws 26 may be used. Alternately, the embed 12, end seals 22 and end closure arms 20 may be welded together.

The configuration of the end closure arms 20 and the end seals 22 may vary. FIGS. 4, 5, and 6 illustrate various configurations of the end closure arms 20 and the end seals 22 but other configurations, as would be known to one skilled in the art, may be used. In FIGS. 4 and 5, the end closure arms 20 comprise supporting extensions 21 extending laterally over the embed 12. In those embodiments, the profile of the end closure arms 20 thus varies along a portion of the end closure arms 20. In FIG. 4, the end seal 22 correspondingly has a varied profile. In contrast, in FIG. 5, the end seal 22 has a profile that remains substantially unchanged over the entire length thereof. In FIG. 6, no end seal 22 is used and the profile of the end closure arms 20 remains substantially unchanged over the entire length thereof.

In alternate embodiments, only the end seals 22 may be used to seal the sides 24 of the embed 12. Alternately, other means of sealing the sides 24 of the embed 12 may be employed. For example, the embed 12 may be manufactured with closed sides 24.

Figure 7:
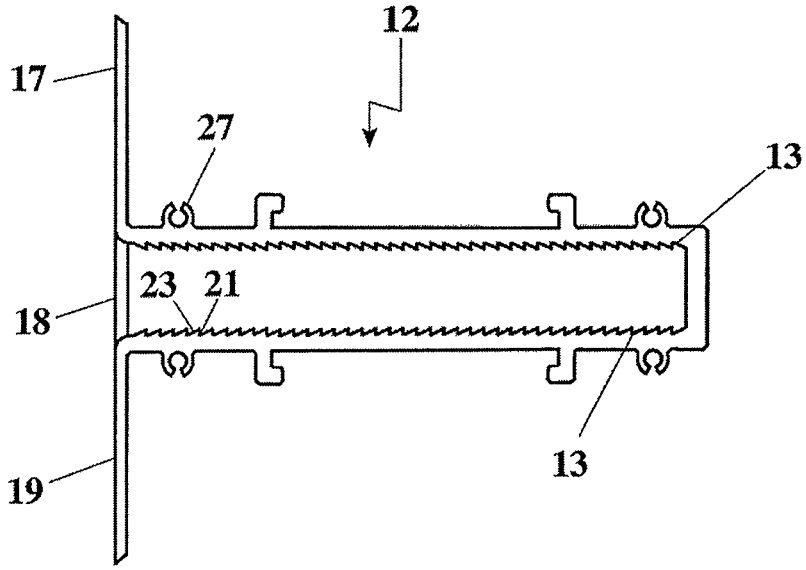
FIG. 7 illustrates a side view of an embed for use with an adjustable attachment system in accordance with one embodiment of the present invention.
Figure 8:
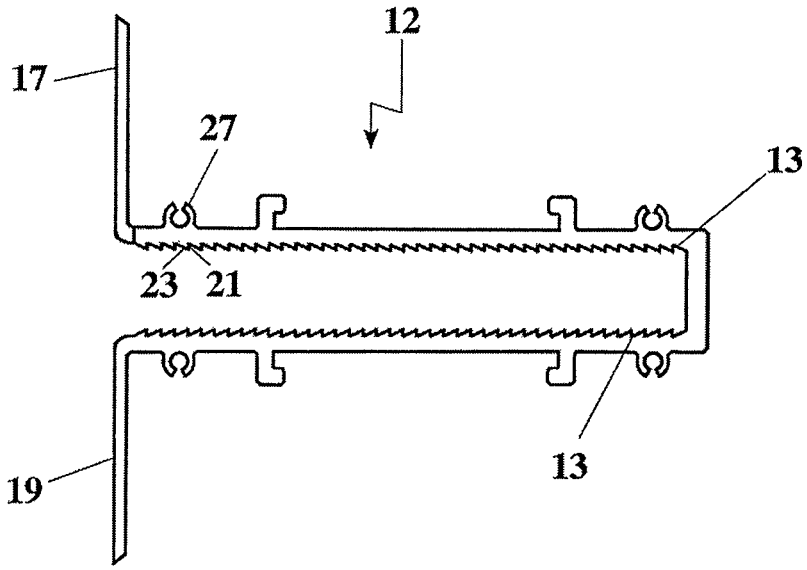
FIG. 8 illustrates a side view of an embed for use with an adjustable attachment system in accordance with one embodiment of the present invention.
Figure 9:
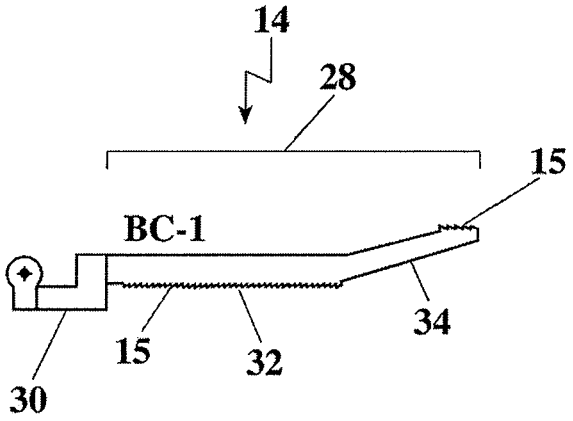
FIG. 9 illustrates a side view of a bridging clip for use with an adjustable attachment system in accordance with one embodiment of the present invention.
Figure 10:
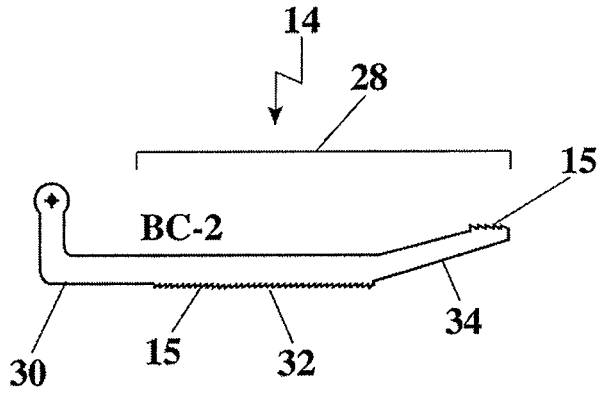
FIG. 10 illustrates a side view of a bridging clip for use with an adjustable attachment system in accordance with one embodiment of the present invention.
Figure 11:
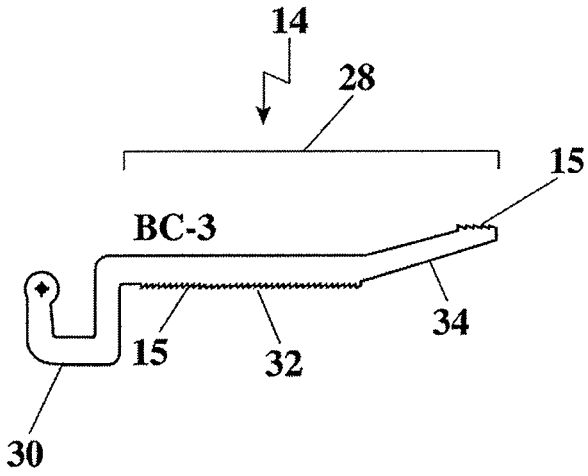
FIG. 11 illustrates a side view of a bridging clip for use with an adjustable attachment system in accordance with one embodiment of the present invention.
Figure 12:
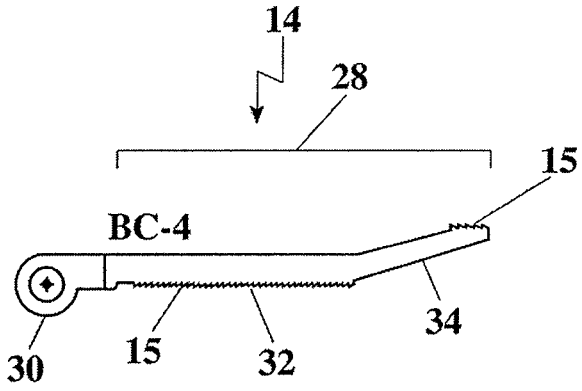
FIG. 12 illustrates a side view of a bridging clip for use with an adjustable attachment system in accordance with one embodiment of the present invention.

The embed 12 may be provided with a peel strip 18. The peel strip 18 seals a front portion 26 of the embed 12. The embed 12, may thus be positioned in the recess with the peel strip 18 intact. FIG. 7 illustrates an embed 12 with the peel strip 18 intact. In attaching a curtainwall to a building frame, the embed is positioned in a concrete form and concrete is poured. Once positioned and once surrounding concrete is hardened and/or there is a reduced risk of intrusion of materials through the front portion 26 of the embed 12, the peel strip 18 may be removed. FIG. 8 illustrates an embed 12 with the peel strip 18 removed. The embed 12 and peel strip 18 may be provided in any configuration suitable for removal of the peel strip 18 from the front portion 26 of the embed 12. For example, perforations or grooves may be provided along the border of the peel strip 18 with the embed 12. Provision of a peel strip 18 enables the embed 12 to be extruded as a hollow rather than a semi-hollow. In lieu of a peel strip, a plug may be provided along the front portion 26 of the embed 12. For example, a closed cell foam plug may be used to seal the interior of the embed 12 along the front portion 26 of the embed 12.

As can be seen in FIGS. 4-8, the embed 12 has a front facing portion including lips 17 and 19. The extension of the lips 17 and 19 may vary. Further, the extension of the upper lip 17 may be different from the extension of the lower lip 19. The lips 17, 19 extend along the outward facing surface of the frame. The embed 12 may further be provided with rebar holes 27 for receiving a rebar rod to reinforce the embed 12.

Teeth 13 and 15 are provided along a surface of the bridging clip 14 and a surface of the embed 12. The teeth 13 and 15 engage one another to fix the bridging clip 14 within the embed 12. In alternate embodiments, other means of engaging the bridging clip 14 with the embed 12 may be used. For example, the bridging clip 14 may be fastened to the embed 12 using conventional fasteners, other friction fitting, or any suitable means.

The teeth 13 of the embed 12 and the teeth 15 of the bridging clip 14 may be configured in any engaging configuration so long as the teeth 13 engage with the teeth 15. In one embodiment, as seen most clearly in FIGS. 7 and 8, the teeth 13 of the embed 12 comprise an upwardly extending portion 21 and a slanted surface 23, the slanted surface 23 extending from a base point along the embed 12 to the top point of the upwardly extending portion 21. As shown, the slanted surfaces 23 extend rearwardly away from the front facing portion of the embed 12. The corresponding teeth 15 on the bridging clip 14 comprise an upwardly extending portion and a slanted surface wherein the slated surface extends forwardly towards a front facing portion of the bridging clip 14. Thus, the teeth 15 of the bridging clip 14 slide along the surface of the teeth 13 of the embed 12. Once in position, the teeth 15 of the bridging clip 14 engage the teeth 13 of the embed 12 and the bridging clip 14 cannot be removed merely by pulling on bridging clip 14. To remove the bridging clip 14, the bridging clip must be lifted or otherwise positioned to disengage the teeth 15 of the bridging clip 14 from the teeth 13 of the embed 12.

FIGS. 9-19 illustrate various embodiments of a bridging clip 15. As shown, the bridging clip 14 comprises an insertion portion 28 and an end portion 30. The insertion portion 28 comprises a planar portion 32 and an angled portion 34. In the embodiments shown, the angled portion 34 angles upwardly. A lower surface of the planar portion 32 and an upper surface of the angled portion 34 include teeth 15. Alternately, the bridging clip 14 may be configured with an angled portion extending downwardly, teeth 15 being provided on a lower surface of the angled portion 32 and an upper portion of the planar portion 28. Further, only one of the planar portion 30 and the angled portion 32 may be provided with teeth.

Figure 13:
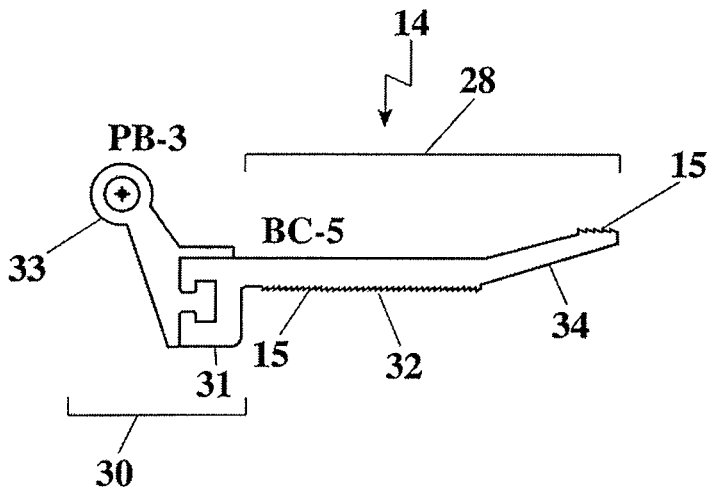
FIG. 13 illustrates a side view of a bridging clip for use with an adjustable attachment system in accordance with one embodiment of the present invention.
Figure 14:
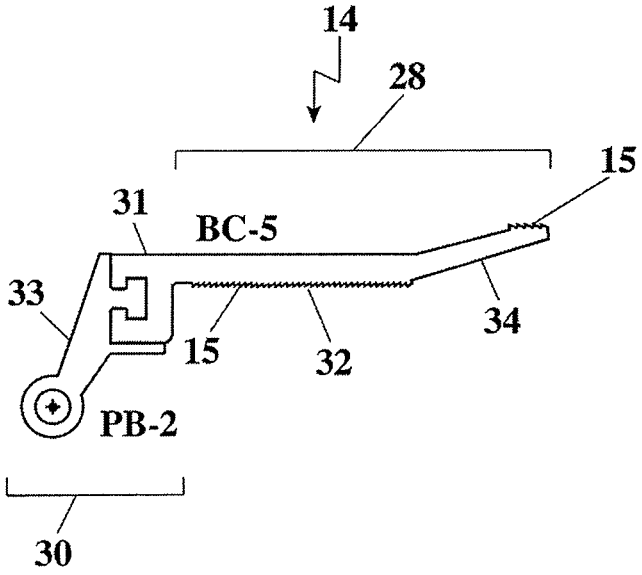
FIG. 14 illustrates a side view of a bridging clip for use with an adjustable attachment system in accordance with one embodiment of the present invention.
Figure 15:
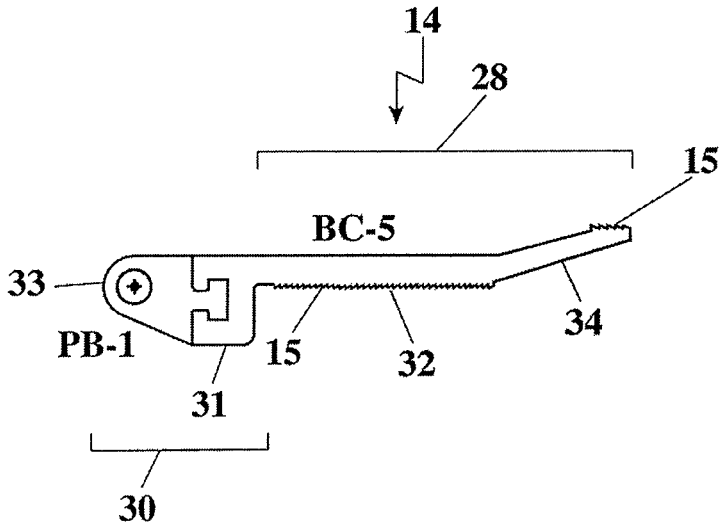
FIG. 15 illustrates a side view of a bridging clip for use with an adjustable attachment system in accordance with one embodiment of the present invention.
Figure 16:
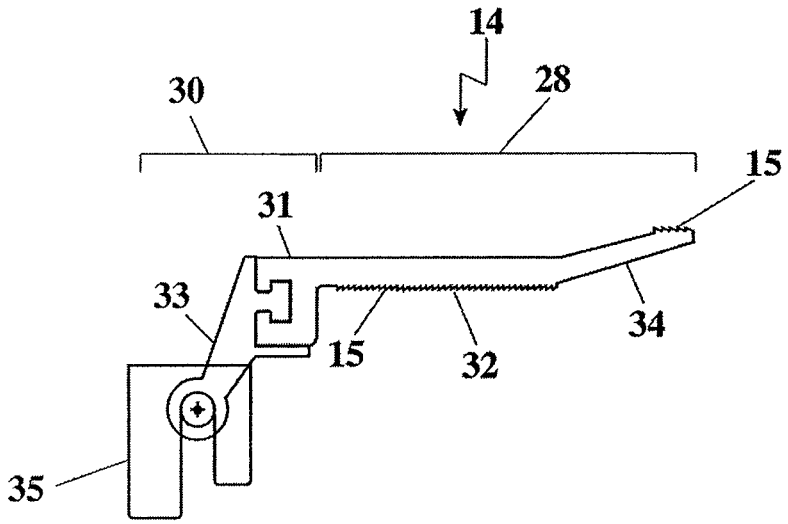
FIG. 16 illustrates a side view of a bridging clip for use with an adjustable attachment system in accordance with one embodiment of the present invention.
Figure 17:
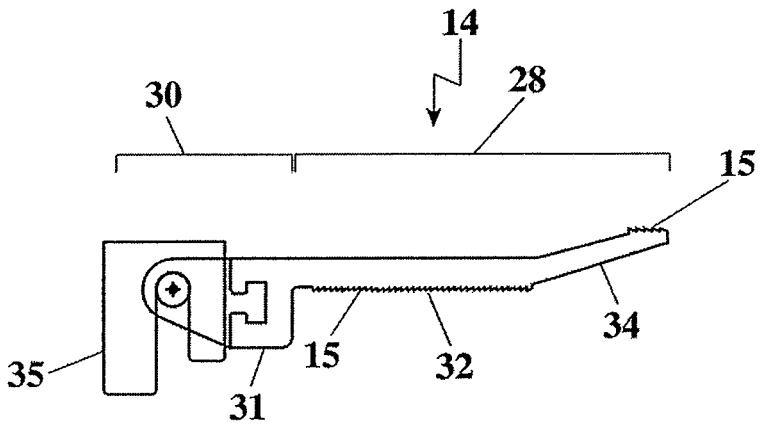
FIG. 17 illustrates a side view of a bridging clip for use with an adjustable attachment system in accordance with one embodiment of the present invention.
Figure 18:
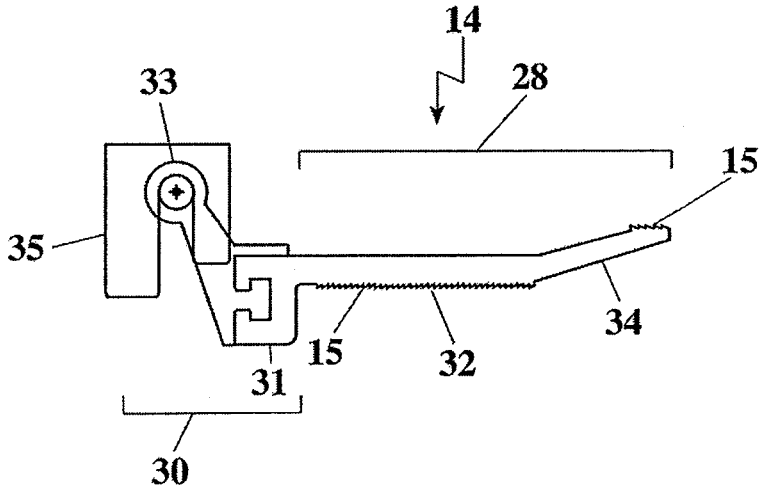
FIG. 18 illustrates a side view of a bridging clip for use with an adjustable attachment system in accordance with one embodiment of the present invention.

Each of FIGS. 9-15 illustrate alternate embodiments of end portions 30 of a bridging clip 14. The configuration of the end portion 30 and/or the provision of an attachment piece may be used to afford further adjustability to the adjustable attachment system. FIGS. 13-15 illustrate bridging clips 14 having end portions 30 comprising a hook portion 31 and an extending portion 33. In FIGS. 13-15, the hook portions 31 are substantially the same with the end portion 30 being varied for engagement with attachment pieces 35.

FIGS. 16-19 illustrate attachment pieces 35 engaged with the end portions 30 of the bridging clips 14. After positioning of the adjustable attachment system 10 in the frame, an attachment piece 35 may be provided to engage the end portion 30 of the bridging clip 14. Thus, the configuration of the end portion 30 determines the placement of the unit from the adjustable attachment system 10. Thus, for example, the unit may be placed at a slightly varying distance from the adjustable attachment system 10. Further, the unit may be hung such that the upper limit of the attachment piece 35 is at the same plane as the adjustable attachment system 10 (see, for example, FIGS. 17 and 19), is above the plane of the adjustable attachment system (see, for example, FIG. 18), or is below the plane of the adjustable attachment system (see, for example, FIG. 16).

Referring back to FIG. 6, a bridging clip 14 is shown having only a planar portion 32.

Figure 19:
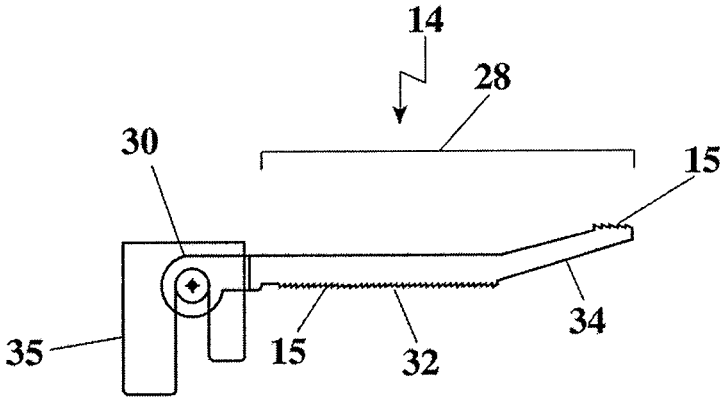
FIG. 19 illustrates a side view of a bridging clip for use with an adjustable attachment system in accordance with one embodiment of the present invention.
Figure 20:
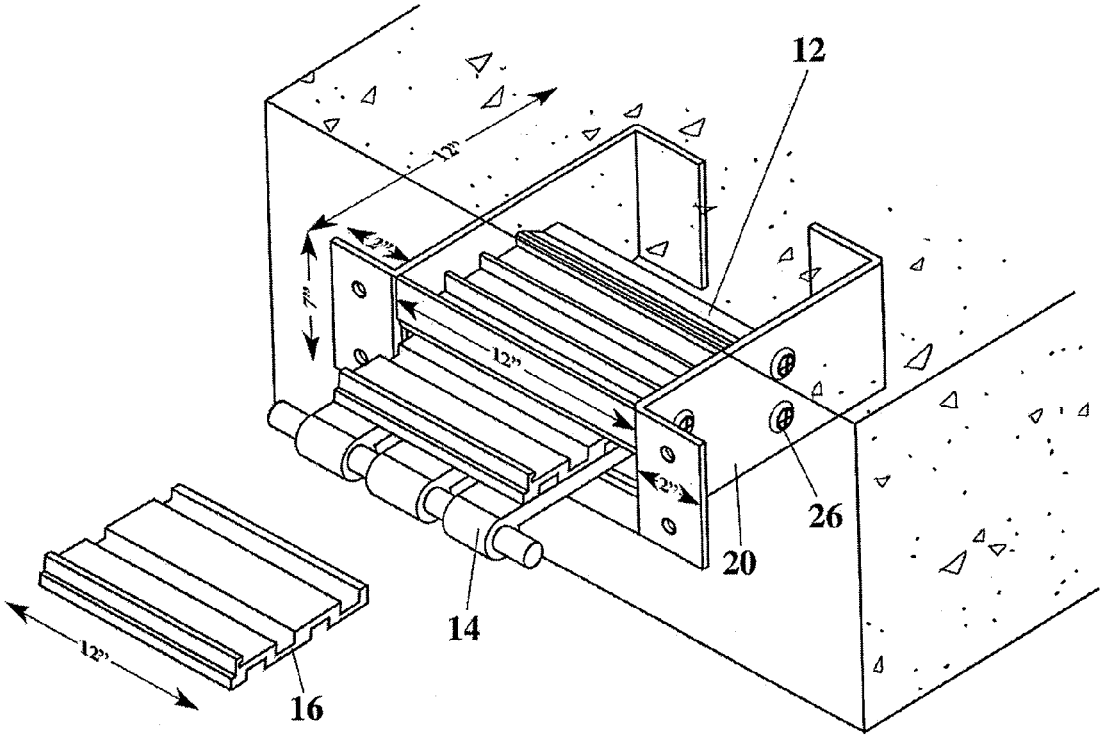
FIG. 20 illustrates a side view of a locking strip 16 being inserted into an adjustable attachment system in accordance with one embodiment of the present invention.
Figure 21:
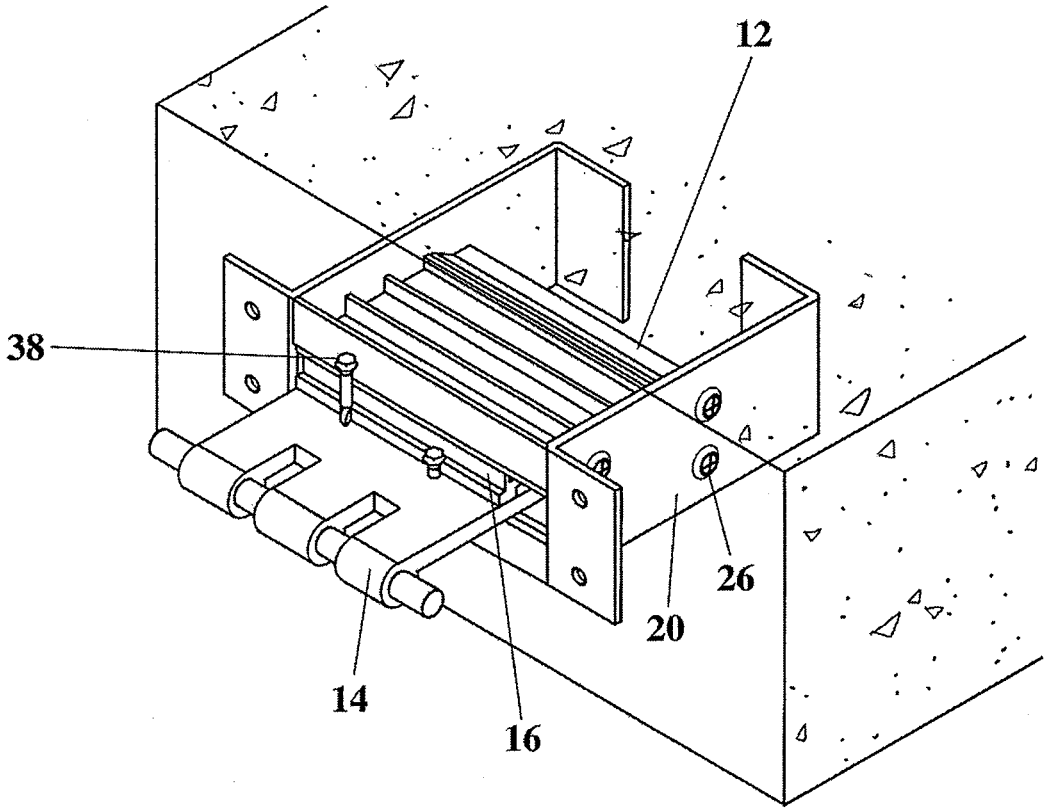
FIG. 21 illustrates a side view of a locking strip 16 being fixed into place in an adjustable attachment system in accordance with one embodiment of the present invention.

Each of FIGS. 4, 5, and 6 illustrate alternate embodiments of a locking strip 16. Any suitable configuration of locking strip 16 may be used so long as it operates to fix the bridging clip 14 into the embed 12 in the desired position. Permanent fixtures may be used to permanently fix the locking strip 16 in place. FIGS. 19 and 20 illustrate the locking strip 16 being inserted between the embed 12 and the bridging clip 14 and the locking strip 16 being fixed in place using fasteners 38.

Figure 22:
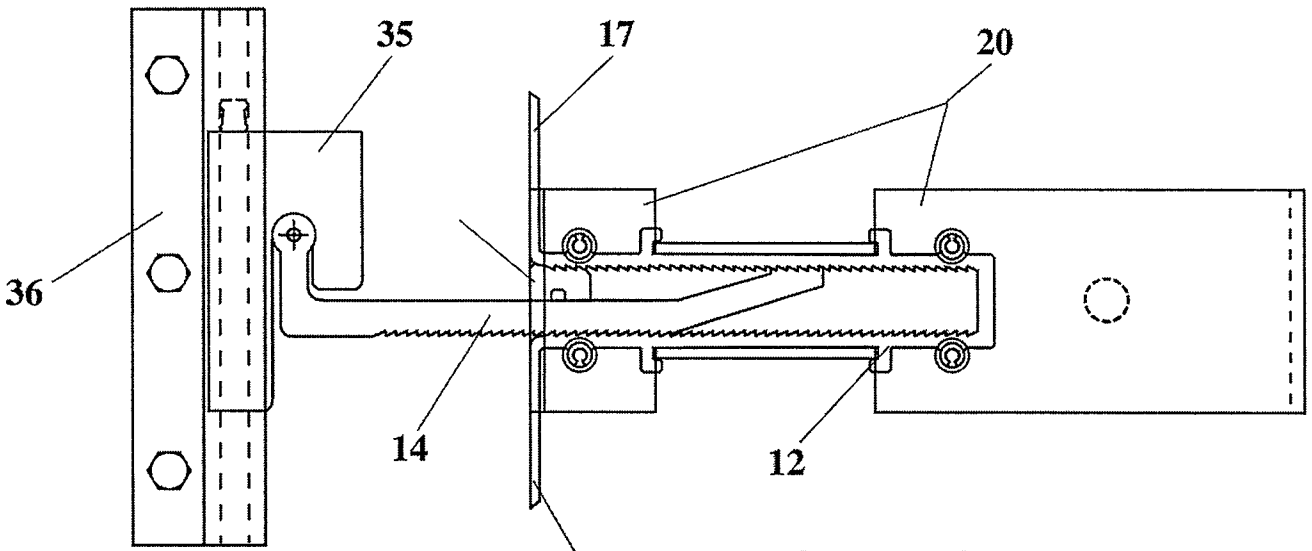
FIG. 22 illustrates a side view of an assembled adjustable attachment system with a curtainwall hanging therefrom in accordance with one embodiment of the present invention.
Figure 23:
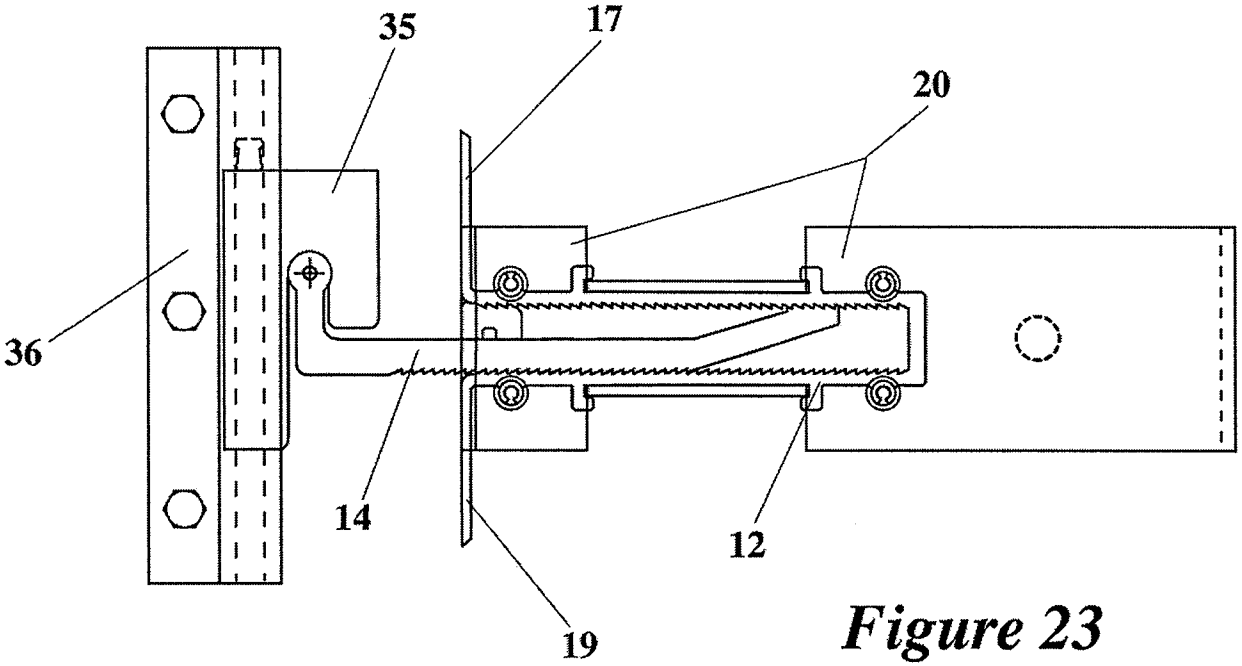
FIG. 23 illustrates a side view of an assembled adjustable attachment system with a curtainwall hanging therefrom in accordance with one embodiment of the present invention.
Figure 24:
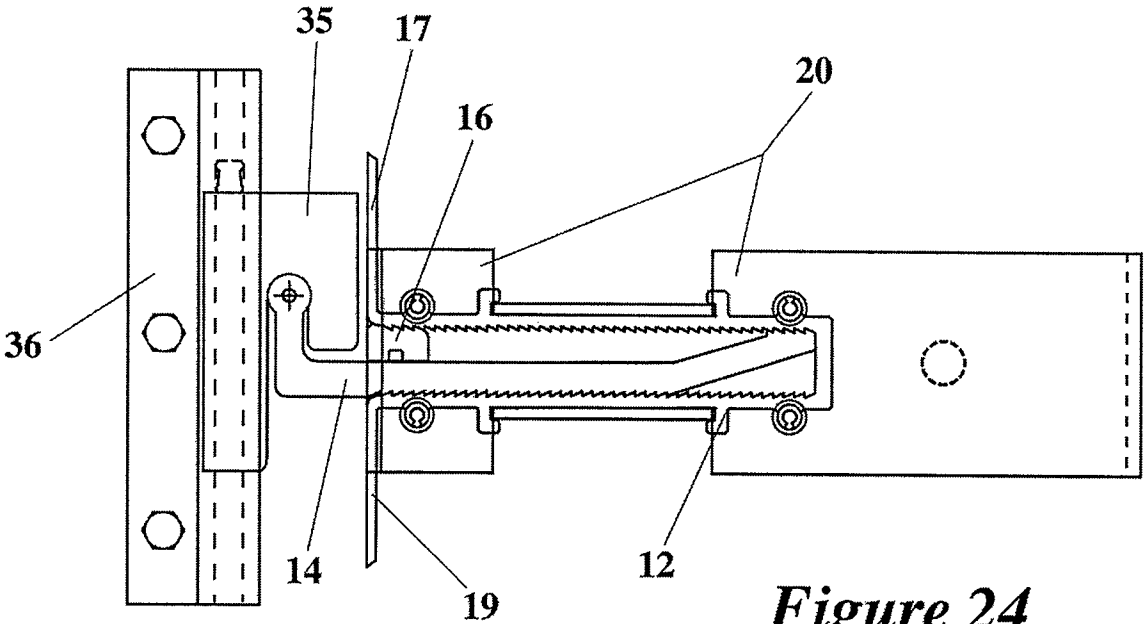
FIG. 24 illustrates a side view of an assembled adjustable attachment system with a curtainwall hanging therefrom in accordance with one embodiment of the present invention.

FIGS. 22, 23, and 24 show assembled adjustable attachment system with a curtainwall unit 36 hanging therefrom. Each of FIGS. 22, 23, and 24 show a bridging clip 14 at a different position. FIG. 22 illustrates an in/out position of the bridging clip 14 within the embed 12 wherein the attachment piece 35 and attached curtainwall unit 36 hang some distance from the outward facing surface of the frame. FIG. 23 illustrates an in/out position of the bridging clip 14 within the embed 12 wherein the attachment piece 35 and attached curtainwall unit 36 hang a distance from the outward facing surface of the frame less than the distance of FIG. 22. FIG. 23 illustrates an in/out position of the bridging clip 14 within the embed 12 wherein the bridging clip 14 is at its maximum depth within the embed 12 and, thus, the attachment piece 35 and attached curtainwall unit 36 hang a minimal distance from the outward facing surface of the frame.

Figure 25:
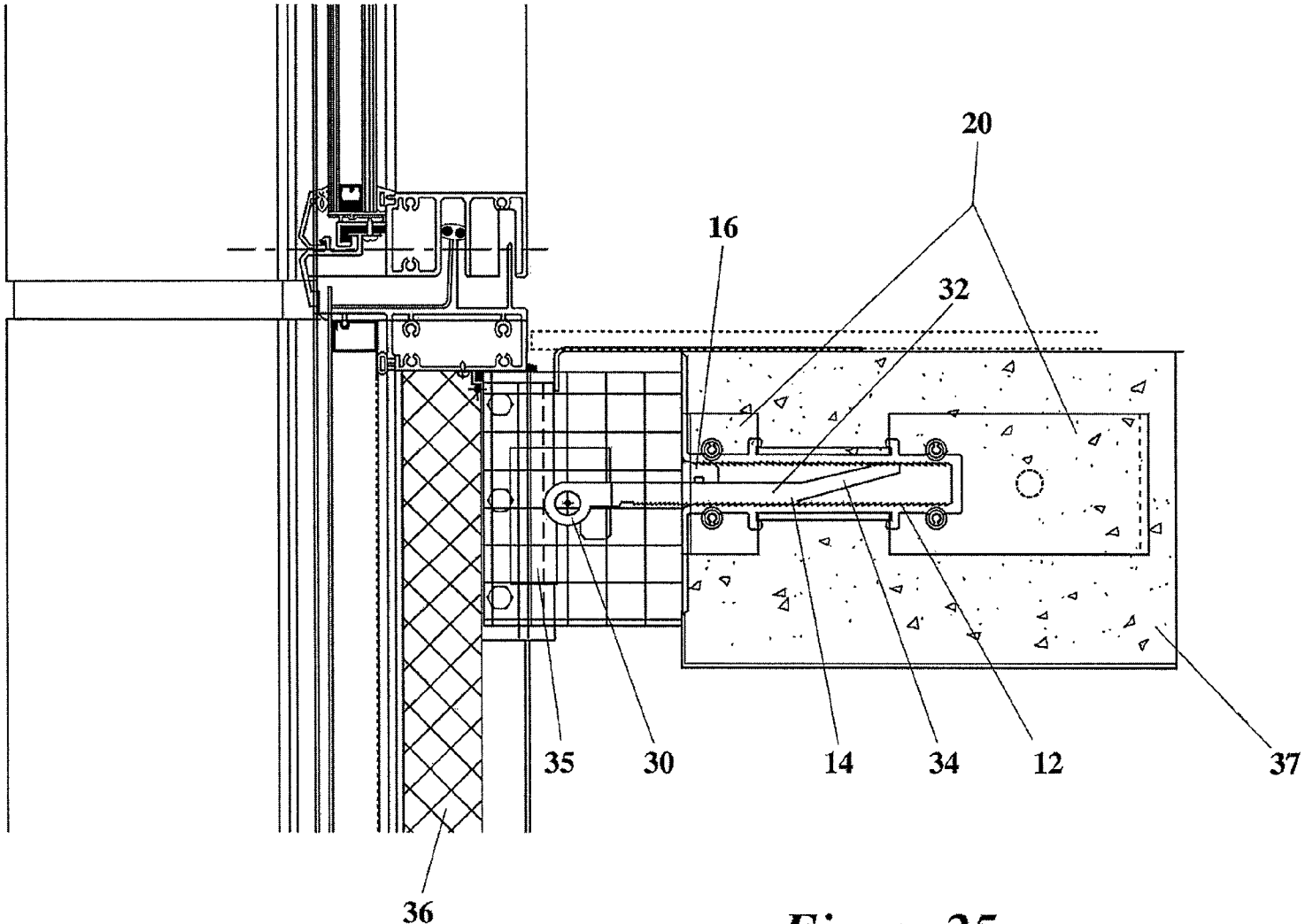
FIG. 25 illustrates a side view of an assembled adjustable attachment system positioned in a frame with a curtainwall hanging therefrom.
Figure 26:
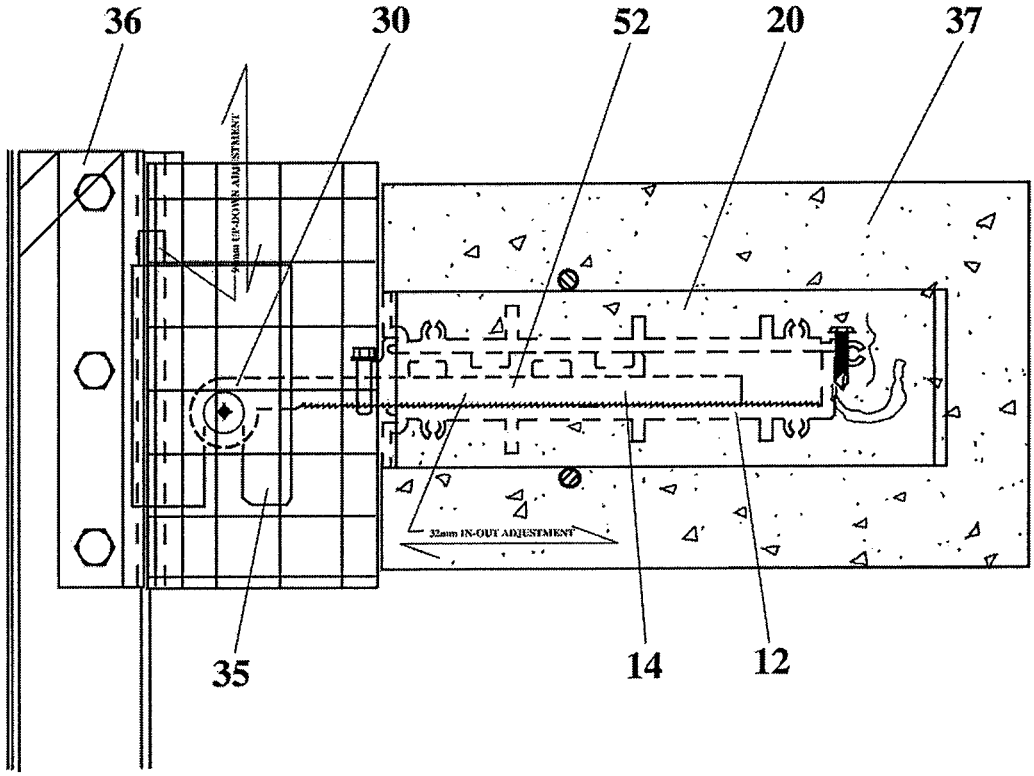
FIG. 26 illustrates a side view of an assembled adjustable attachment system positioned in a frame with a curtainwall hanging therefrom.

FIGS. 25 and 26 illustrate adjustable attachment systems 10 positioned in a frame 37 with an attachment piece 35 and attached curtainwall unit 36 hanging therefrom. In the embodiment of FIG. 25, the bridging clip 14 comprises an insertion portion having a planar portion 32 and an angled portion 34. In the embodiment of FIG. 26, the bridging clip 14 comprises an insertion portion having only a planar portion 32.

The embed 12 may be manufactured of any suitable material. For example, the embed 12 may be manufactured of extruded or cast aluminum or cast or forged steel. Thus, the embed 12 may be manufactured using any suitable process including extrusion (as a hollow or a semi-hollow), casting, and forging. Further, the embed 12 may be manufactured of plastic or other materials. The surfaces of the embed 12 that are exposed to the frame may be pretreated to resist corrosion or galvanic reaction. Thus, the embed may be covered with an isolation material. For example, when the embed 12 is to be placed in a concrete frame, the surfaces of the embed 12 to be exposed to the concrete may be pretreated with bituminous paint, dielectric isolator tape, or other protecting coating. The bridging clip 14 may also be manufactured of any suitable material. For example, the bridging clip 14 may be manufactured of extruded or cast aluminum or cast or forged steel. The teeth 13 of the embed 12 and the teeth 15 of the bridging clip 14 are matched to engage and interlock, thereby allowing adjustments to be made to locate the bridging clip 14 both in and out and laterally from the plane of the frame, the face of the slap, the column or shear wall.

For attaching a curtainwall unit to a building frame, the adjustable embed 12 (with end closure arms 20 and end seals 22 if provided) may be placed in concrete forms prior to pouring of the concrete with a designated face to be placed against the formwork. After pouring, the inside of the embed 12 is accessed by removing the peel strip 18 (or other sealing means) at the designated outboard positioned face after the formwork has been removed. The bridging clip 14 may then be inserted and positioned within the embed 12. After positioning, the locking strip 16 is inserted into the known dimensioned space above the bridging clip 14. In some embodiments, an end portion 30 may be coupled to the bridging clip 14 to customize the position of the curtainwall with respect to the adjustable attachment system 10.

Figure 27:
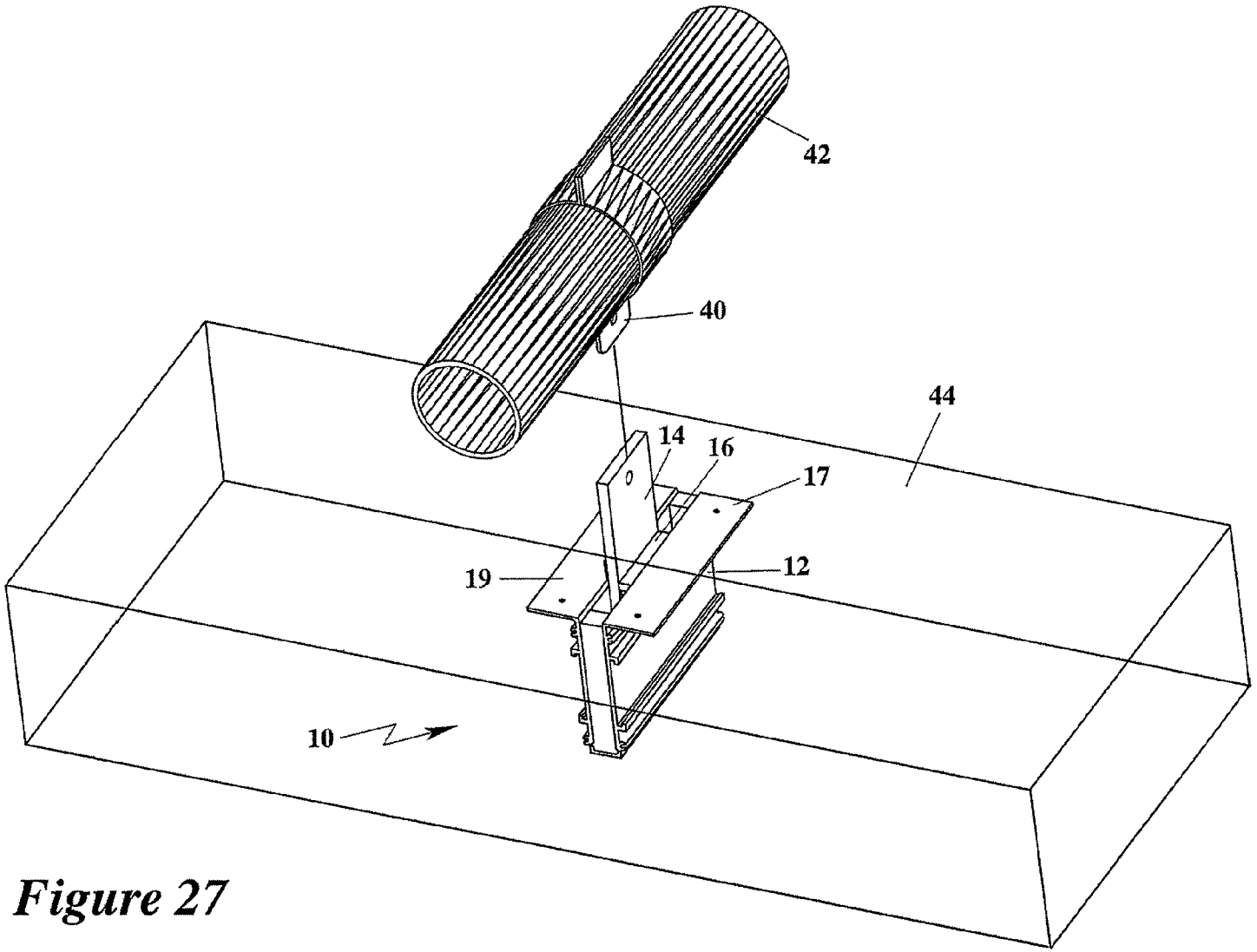
FIG. 27 illustrates an exploded perspective view of an adjustable attachment system for attaching a pipe to a base in accordance with one embodiment of the present invention.

FIG. 27 illustrates an adjustable attachment system used for attaching a pipe 42 to a base 44. The adjustable attachment system 10 comprises an embed 12, a bridging clip (or anchor plate) 14, and a locking strip (or wedge block) 16. The embed 12 is positioned in a recess in an outward facing surface of base. The outward facing surface may be any surface of the base. Thus, for example, the outward facing surface may be a top surface, a bottom surface, or a side surface. The bridging clip 14 is inserted into the embed 12 to a desired in/out position. As with the embodiments described above, teeth are provided along at least one of an upper and lower inner surface of the embed. Corresponding teeth are provided along at least one of an upper and lower surface of the bridging clip. Once the bridging clip 14 is in the desired in/out position, the teeth on the bridging clip 14 are engaged with the teeth of the embed 12. The position of the bridging clip 14 in the embed 12 may be adjusted laterally. When the desired position is achieved, the locking strip 16 is inserted between the bridging clip 14 and the embed 16 to fix the bridging clip 14 in place. An attachment piece 40 is provided configured for attachment to a pipe 42. The attachment piece 40 is coupled to the bridging clip 14. In alternative configurations, other configurations of attachment piece 40 may be provided for attachment to other units.

The adjustable attachment system may be used for attaching any suitable unit to any suitable base. For example, the base may be a wood, drywall, brick, concrete, steel, or other. The base may comprise a frame structure, a wall, a ceiling, a floor, or any other structural component. The embed 12 of the attachment system may be provided in the base in any suitable manner. For example, the embed 12 may be placed in concrete, the embed 12 may be built into a brick wall, the embed 12 may be anchored into a drywall sheet, or the embed 12 may be fastened to a wood piece.

The length of the embed 12 and the bridging clip 14 may be varied to vary the load capacity of the adjustable attachment system 10. More specifically, the longer the embed 12 and the bridging clip 14, the higher the load capacity of the adjustable attachment system 10. Further, in order to increase the load capacity of the adjustable attachment system 10, rebar may be slid through the embed 12.

Although the present invention has been described with reference to preferred embodiments, persons skilled in the art will recognize that changes may be made in form and detail without departing from the spirit and scope of the invention.

The invention claimed is:

1. An adjustable attachment system for suspending a curtain wall comprising:

an embed configured to be connected to a base, the embed including a top surface;

a bottom surface; and an embed engagement feature extending from one of the top surface or the bottom surface;

an adjustment piece comprising a planar portion having a first surface and a second surface, an angled portion extending from a first end of the planar portion, an end portion extending from a second end of the planar portion, and an adjustment engagement feature, and the adjustment piece is configured to be at least partially received between the top surface and the bottom surface of the embed; wherein:

the adjustment engagement feature comprises a first engagement feature and a second engagement feature, and the first engagement feature is integrally formed in and extends from the first surface of the planar portion and the second engagement feature is integrally formed in and extends from a surface of the angled portion; and in a first position the adjustment engagement feature engages the embed engagement feature to secure the adjustment piece in a first location and is capable of movement to a second position where the adjustment engagement feature engages the embed engagement feature to secure the adjustment piece to the embed in a second location.

2. The adjustable attachment system of claim 1, wherein the first surface is a portion of a bottom surface of the planar portion.

3. The adjustable attachment system of claim 1, wherein the first surface of the planar portion engages with the bottom surface of the embed and the surface of the angled portion engages with the top surface of the embed.

4. The adjustable attachment system of claim 1, wherein the first engagement feature and the second engagement feature of the adjustment engagement feature comprises a plurality of teeth.

5. The adjustable attachment system of claim 1, wherein the embed engagement feature comprises a plurality of teeth.

6. The adjustable attachment system of claim 1, further comprising lips extending laterally along a front face of the embed.

7. The adjustable attachment system of claim 6, further comprising a peel strip extending laterally along the front face of the embed.

* * * * *